United States Patent [19]

Blackwood

[11] 4,004,130

[45] Jan. 18, 1977

[54] HOT PLATES

[75] Inventor: Robert S. Blackwood, Chanhassen, Minn.

[73] Assignee: Fluoroware Systems Corporation, Chaska, Minn.

[22] Filed: Oct. 23, 1975

[21] Appl. No.: 625,136

[52] U.S. Cl. ..... 219/459; 99/422; 219/460; 219/464; 219/544

[51] Int. Cl.[2] ..... H05B 3/68

[58] Field of Search ..... 99/372, 377, 422, 447; 219/345, 451, 457, 459, 460, 462, 463, 464, 524, 525, 530, 541, 544

[56] References Cited

UNITED STATES PATENTS

| | | | |
|---|---|---|---|
| 1,174,030 | 2/1916 | Hadaway, Jr. | 219/460 |
| 1,237,592 | 8/1917 | White | 219/457 |
| 1,348,648 | 8/1920 | Kelly | 219/460 X |
| 1,654,292 | 12/1927 | Keene et al. | 219/459 |
| 2,644,880 | 7/1957 | Valentini et al. | 219/525 |
| 2,833,908 | 5/1958 | Scofield | 219/465 X |
| 2,978,564 | 4/1961 | Blanding et al. | 219/460 X |
| 3,043,943 | 7/1962 | Moot | 219/460 X |
| 3,733,462 | 5/1973 | Bouchard et al. | 219/464 |
| 3,870,861 | 3/1975 | Werych | 219/459 |
| 3,936,660 | 2/1976 | Blackwood | 219/459 |

*Primary Examiner*—Volodymyr Y. Mayewsky
*Attorney, Agent, or Firm*—H. Dale Palmatier

[57] ABSTRACT

A hot plate with a base and a heater plate, both the heater plate and the base being hollow and filled with an expanded and voluminously enlarged foam epoxy encapsulating the lead and power wires and pressing the electric resistance heater ribbon firmly against the ceramic top deck and extruding around the closure plate to seal and secure the entire heating plate and base in single unitary units. The method disclosed includes the pouring of the foaming epoxy system wherein the epoxy expands and creates a pressure within the cavities or chambers of the hot plate and urges the resistance heater firmly against and in intimate engagement with the top deck of the ceramic panel by reason of the growth of the foaming epoxy which seals and insulates against heat migration.

6 Claims, 6 Drawing Figures

HOT PLATES

INTRODUCTION AND BACKGROUND

This invention relates generally to hot plates and more particularly to industrial hot plates for use in highly corrosive environments including operations involving the use of active chemical agents of both high acidity and high alkalinity.

The prior art is replete with both hot plates of the type disclosed. The more recent ones utilize ceramic materials for the heated working surface or top and, as such, these ceramic tops are very resistant to chemical reaction with virtually all of the various chemicals that may be employed as well as being capable of withstanding high temperatures. One such ceramic top made is commercially available from the Corning Glass Works in Corning, New York, and can be purchased complete with a ribbon heating element, backing plate and mounting clips fully assembled less electrical power connectors and controls.

But even the most advanced designed hot plates, whether they employ the commercially available Corning Glass Works ceramic hot plate or other unknown but suitable substitutes, have failed to meet the specifications demanded in certain industries simply because the various base structures to which these ceramic tops are affixed are manufactured from materials which subsequently fail due to the corrosive chemicals employed. Then too, in many instances failure of the hot plate can be directly attributed to an inadequately protected electrical supply line to the heating element, especially in those instances where the base structures stand on wet or liquid covered surfaces.

SUMMARY OF THE INVENTION

In the present invention, the deficiencies in construction and method of making the hot plate are materially improved by providing a hot plate that is almost impervious to acid and alkali solutions and other hostile environments.

The hot plate is also provided with improved heating capabilities because the electrical heater ribbons or elements are pressed and held firmly against the inner surface of the ceramic top panel or hood. This results in improved and more rapid transfer of heat to and through the ceramic panel and to the heating load carried on the panel.

The physical pressure, by which the heater ribbons are held against the ceramic panel, is produced by the growth of the epoxy insulating material which is confined, while growing in volume, with the ribbon heater adjacent the ceramic panel. The space within the dished ceramic panel is closed by a plate which is clamped in place. The asbestos covered lead wires connected to the heater ribbon are encased in a sleeve of one of the fluorocarbon plastic materials which is highly resistant to high temperatures. The sleeve with the lead wire therein emerges from the confined space through an opening in the plate. The growing epoxy, which assumes a foamed condition, oozes around the edges of the plate adjacent the ceramic panel and adjacent the sleeve-covered lead wires to seal and secure tightly and to rigidly integrate several parts into a single sealed unit.

The base of the hot plate is spaced from the heat emitting top except at a number of connecting posts. The base also has a hood shaped housing defining a wiring chamber closed at its bottom by a plate. Both the hood and the bottom plate of the base are of high temperature resistant fluorocarbon type plastic such as a PFA fluorocarbon resin, which is commonly known by the trademark "Teflon," sold by the DuPont Company, more specifically a perfluoroalkoxy-substituted polytetrafluoroethylene-type resin. The chamber in the base is filled with the same foaming epoxy which grows as it sets up, as used in the top of the hot plate. The hood of the base has a domed or arched top surface which confronts the upper portion of the hot plate in spaced relation. The hood also has a number of integral upstanding posts through which connecting screws extend for attaching the hot plate together. The sleeve-covered lead wires extend through the holes in the hood and into the wiring chamber for connection to the power cable which extends from the base to a power supply receptacle.

As in the upper portion of the hot plate, the foaming epoxy grows and oozes around the edges of the plate and adjacent the sleeve-covered wires entering the base and seals the entire base into a single sealed unit.

DETAILED DESCRIPTION OF THE INVENTION

Figure 1:
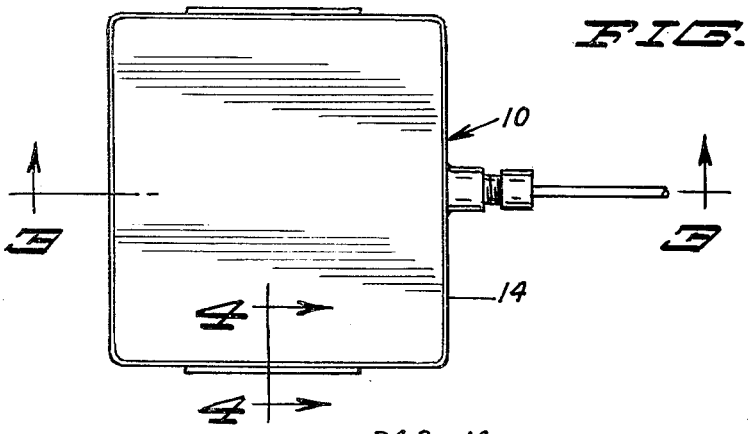
FIG. 1 is a top plan view of the hot plate.

Referring now to the drawings, shown there in FIG. 1 is a hot plate 10 constructed in accordance with the invention. The hot plate 10 includes a base 12 upon which is operatively mounted a heated frame portion or heater plate 14.

Figure 2:
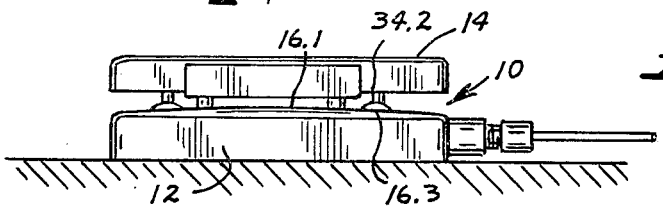
FIG. 2 is a side elevation view of the hot plate.
Figure 3:
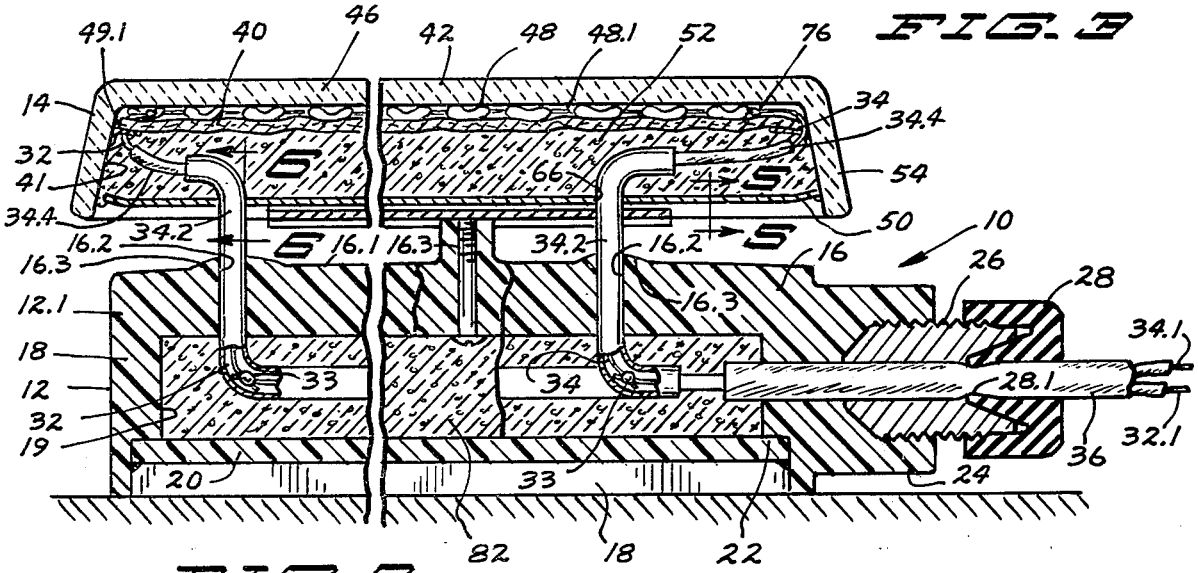
FIG. 3 is a greatly enlarged detailed section view, partly broken away for clarity of detail and taken along a line as indicated at 3—3 in FIG. 1.

The base 12 includes a hood-shaped housing 12.1 and a bottom wall or panel 20, both of which are formed of a suitable plastic material preferably from a class known as fluorocarbons which are extremely resistant to the effects of corrosive chemicals and other hostile environments. The housing 12.1 includes a top wall 16 and downturned side walls 18 which extend around the entire periphery of the top wall and are formed integrally of each other and with the top wall to entirely close the top and sides of the wiring chamber 19 formed within the housing. The side walls 18 have a continuous shoulder or recess 22 extending entirely around the periphery of the housing 12.1 to receive and seat the bottom wall 20. It will be noted in FIGS. 2 and 3 that the top face 16.1 of the top wall 16 of the housing 12.1 has an arched shape so that the central areas of the top face 16.1 are elevated above the peripheral edges thereof, to thereby prevent any liquid chemicals from collecting on the top face 16.1 of the housing.

The top wall 16 of the housing 12.1 also has a plurality of openings 16.2 extending therethrough to permit passage of lead wires or electrical conductors 32 and 34 which are covered with an asbestos insulation 34.1 and encased in protective sleeves 34.2 formed of fluorocarbon type plastic which is highly resistant to the corrosive action of chemicals, such as plastic frequently being known by its trademark "Teflon" of the DuPont Company.

The top wall 16 of the housing 12.1 also has an upwardly protruding dome-shaped annular boss 16.3 surrounding the upper end of each of the openings 16.2 to prevent the collection of any liquid materials in the vicinity of the opening 16.2.

On one of the side walls 18, a suitable fitting or coupling 24 is formed integrally thereof to receive the power wires 32.1 and 34.1 into the wiring chamber 19. The fitting 24 includes a threaded sleeve 26 and a compression cap 28 which is deformed at 28.1 when tightened to produce a tight seal around the fluorocarbon plastic sleeve 36 which encases the conductors 32.1 and 34.1.

It will be understood that the conductors 32.1 and 34.1 will be connected to a suitable power source, such as a plug and receptacle.

Within the wiring chamber 19, and within the plastic sleeves 34.2, the power wires 32.1 and 34.1 are joined to the lead wires 32 and 34, as indicated at 33. The temperatures within the base 12 do not rise to extreme levels and therefore the power wires 32.1 and 34.1 are provided with a polyvinyl chloride (PVC) insulation.

The wiring chamber 19 is entirely filled with a foamed epoxy encapsulation 82 more fully described hereinafter.

The heater plate or heated frame portion 14 of the hot plate 10 includes a ceramic body or panel 40 with downturned side walls 54 defining an interior heater cavity 41. The heater plate 14 also includes an electrical resistance heating element or ribbon 48 firmly bearing against the interior surface of the top deck 42 of the ceramic panel 40. The heater ribbon 48 is conventionally mounted on a mica lamina 48.1.

A fibrous pad or insulating layer 49 which is constructed of heat resisting mineral wool and is capable of withstanding the temperature extremes produced by the heater ribbon 48, underlies the heater ribbon 48 and extends across the entire length and breadth of the heater cavity 41. The entire peripheral edge of the mineral wool pad 49 is sealed to the interior surface of the ceramic panel 40 by a heat resistant adhesive tape 49.1 constructed of fibers of glass so as to avoid any migration of other material into the space between the pad 49 and the ceramic panel 40.

The heater cavity 41 is closed at its open bottom by a closure panel 50 which may be constructed of sheet metal such as iron, but which is entirely coated with a fluorocarbon plastic type material which is highly resistant to actions of corrosive chemicals. The closure panel or backing plate 50 is initially retained in enclosing relationship to the cavity 41 by upturned brackets 56 and 58 which are also formed of metal and coated with fluorocarbon type plastic highly resistive to the action of highly corrosive chemicals. The brackets 56 and 58 are welded together and tightly grip the downturned side wall 54 of the ceramic panel. An inwardly protruding flange or clip 46 retains the closure panel 50 in position and has a threaded aperture receiving the connecting stud or screw 64 extending from the base 12 through a post-shaped boss 16.3 which is formed integrally of the top wall 16 of the housing 12.1.

The closure plate 50 has openings 66 to provide access for the conductors 32 and 34 and the encasing sleeve 34.2. It will be recognized that the conductor 34 extends around the edge of the fiber pad 49 and under the adhesive glass fiber tape 49.1 and is connected to the heater ribbon 48 at 76.

Figure 5:
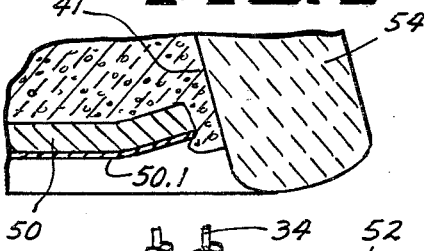
FIG. 5 is a greatly enlarged detail section taken approximately at 5—5 in FIG. 3.
Figure 4:
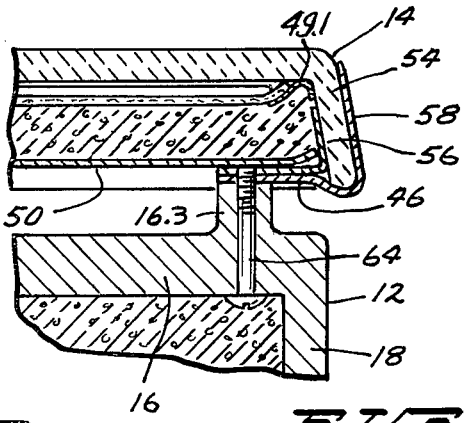
FIG. 4 is a greatly enlarged detail section view taken approximately at 4—4 in FIG. 1.
Figure 6:
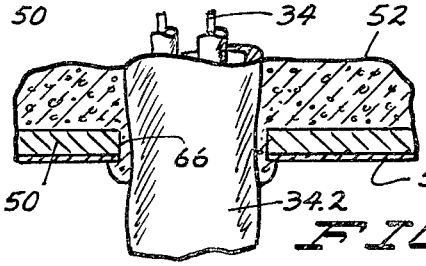
FIG. 6 is a greatly enlarged detail section view taken approximately at 6—6 in FIG. 3.

The heater cavity 41 of the heating plate 14 is entirely filled with a foamed epoxy filler 52 which is identical to the encapsulation 82 in the base 12. The filler 52 and encapsulation 82 in the heating plate and base comprises a high density rigid tough closed cell foam which is resistant to damage due to heat up to temperatures of approximately 240° to 250° C. The epoxy material is a two-component, fast setting low temperature curing system which foams and expands from its original liquid condition by a ratio of 7 to 1 volume expansion. A suitable product for the filler 52 and encapsulation 82 is available under its designation "Delta Epiceram Foam FR-450 A & B" manufactured by Delta Plastics Company, 10102 Greenleaf Avenue, Santa Fe Springs, California. The epoxy foam, when expanding, generates mild pressure within the cavity 41 and chamber 19 up to pressures of 2.5 psi, with the effect that the expanding foam urges the pad 49 toward the ceramic panel 40 and to cause the ribbon heater 48 to bear firmly against the inner surface of the ceramic panel and to be held against the ceramic panel after the foam has been allowed to cure. The cured foam adheres and seals to both the peripheral depending wall of the ceramic panel 40 and to the closure of panel 50. As illustrated in FIG. 5, the foam, as it expands and cures, oozes or extrudes around the edges of the closure panel 50 and the plastic coating 50.1 thereon so as to very tightly seal the entire heater cavity 41 against entrance of any corrosive liquid chemicals or other materials. Similarly, at the plastic sleeve 34.2 which confines the lead wires, the foam extrudes around the edge of the opening in the panel 50 and tightly seals against both the panel 50 and the plastic sleeve 34.2.

Similarly, the foam in the encapsulation 82 extrudes around the edges of bottom plate 20 to very tightly secure and seal the bottom plate to the housing 12.1.

During the curing of the epoxy which produces the foam filler 52 and encapsulation 82, there is an exothermic reaction and a chemical transformation so that the resultant cured rigid foam is part epoxy and part ceramic, thereby having the capabilities of withstanding very substantial temperatures without deterioration.

An important aspect of this invention is the method of making the hot plate to resist the hostile environments including the highly corrosive liquid chemicals that may tend to readily damage other types of hot plates. The method includes the steps of inverting the ceramic hood-shaped top panel 42 and placing the electric resistance heating element or ribbon in the dish-shaped interior of the panel with the electric lead wires connected to the heating element. The electric resistance heatint element is then covered with the mineral wool fibrous high temperature resistant insulating pad 49 and the edges of the pad are taped down to the inner surface of the ceramic panel so that the heater element is wholly confined by the ceramic panel and the pad 49. The two components of the epoxy system are mixed and poured into the wiring cavity 41 and then the closure panel 50 is applied adjacent the open side of the wiring of the heater cavity 41 and the panel 50 is clamped and secured in position by the clips and brackets 46, 56 and 58. The epoxy curing system is then allowed to cure so as to expand in volume to approximately 6 or 7 times the original volume so as to fill the entire heater cavity and to create an internal pressure within the cavity as the foam bears upwardly against the closure panel 50. During the expansion and curing of the foam, the expanding creates a mild fluid pressure within the cavity 41 so as to exert pressure against the pad 49 and urge and ultimately hold the heater ribbon 48 firmly against the inner surface of the ceramic panel 40. Simultaneously in the expansion and foaming of the epoxy system, the foam will ooze or extrude around the edges of the panel 50 adjacent the side walls of the ceramic panel 40 and adjacent the protective sleeve encasing the lead wire.

The epoxy system ultimately cures and adheres firmly to the panels 40 and 50.

In a similar way, the epoxy foam system is applied into the base housing 12.1 to encapsulate the conductors therein and provide for the protection of these conductors and their connections to the power cable extending to the exterior of the base.

It will be seen that I have provided a new and improved method of making a hot plate and the apparatus of the hot plate whereby the resistance heater is held with pressure against the inner surface of the ceramic panel by the foamed and expanded filler in the heater plate, and similarly, the encapsulation in the base tightly seals and adheres the lead wires and power conductors in the base. The base of the hot plate has an arch-shaped upper surface and dome-shaped bosses surrounding the access openings admitting entrance of the lead wires into the base. As a result of the construction, the hot plate withstands the hostile environment found in laboratories where the equipment in use may be exposed to highly corrosive acids and alkali solutions.

What is claimed:

1. A hot plate to resist hostile environments including highly corrosive chemicals, comprising:

a base through which power wires extend;

a horizontal heater plate overlying the base in spaced and confronting relation and including a ceramic panel to carry and transmit heat to the heating load thereon, the ceramic panel having downturned sides and edges spaced below the top face of the panel and defining a heater cavity, the heater plate having lead wires extending from the base to the heater plate and spanning the space therebetween, a bottom panel on the heater plate adjacent the downturned edges of the ceramic panel and having an opening through which said lead wires extend, the heater plate including a foamed epoxy filler in the heating cavity and sealed entirely around the periphery of the ceramic panel to the downturned sides thereof to exclude such corrosive chemicals from the heater cavity, the filler also providing efficient heat insulation against heat loss from the plate;

a high temperature resisting and insulating pad in and extending entirely across the heater cavity between the downturned panel sides and lying between the filler and the ceramic panel; and an electric resistance heating element in the heater cavity and disposed between the pad and the ceramic panel, the heating element being pressed against and in intimate engagement with the ceramic panel and retained against the panel by pressure exerted from the filler and through the high temperature resisting pad to thereby efficiently transfer heat from the heating element to and through the ceramic panel to the heating load carried thereon.

2. The hot plate according to claim 1 wherein the filler in the heater cavity being extruded around the edges of the bottom panel adjacent the downturned sides of the ceramic panel and sealing around said lead wires.

3. The hot plate according to claim 2 and the base having a housing with an arched hood-shaped top confronting said heater plate in spaced relation, the top of said housing having an opening through which such lead wires extend.

4. The hot plate according to claim 3 and said lead wires being enclosed within a sleeve of chemically resistant plastic material, the sleeve extending into the filler in the heater cavity of the hot plate and into the base through the opening in the top of the housing, the base also having a wiring cavity with a foamed epoxy filler sealing the lead wires and enclosing sleeve therein, the top of the housing having an upstanding dome-shaped annular boss surrounding the opening therein and restricting collection and flow of liquid chemicals adjacent the lead wires and opening.

5. A hot plate to resist hostile environments including highly corrosive liquid chemicals, comprising:

a base through which power wires extend, the base having a hood-shaped housing defining a downwardly opening wiring chamber therein and a peripheral supporting shoulder adjacent the opening of the chamber, the housing having an arched top with a wiring access opening therethrough and said top having an upwardly protruding and dome-shaped annular boss surrounding said access opening, the housing having at one side access and sealing means admitting entrance of sealed power wires into said wiring chamber, a bottom plate on said shoulder and spanning said wiring chamber, lead wires in said wiring chamber and protruding outwardly through said access opening in the top of the housing, said lead wires being enclosed within a sleeve of chemically resistant plastic material and said leads being connected to said power wires, a foamed epoxy encapsulation filling said wiring chamber and bearing against the interior of the housing and bottom plate with pressure in sealing and adhering relation, the bottom plate and the housing being formed of chemically resistant fluorocarbon type plastic material; and a horizontal heater plate overlying the base in spaced and confronting relation and including a ceramic panel to carry and transmit heat to the heating load, the ceramic panel extending transversely outwardly beyond the periphery of the base and having downturned sides and edges spaced below the top face of the ceramic panel, the ceramic panel defining a heater cavity within the periphery of said downturned sides, a closure panel on the heater plate adjacent the downturned edges of the ceramic panel and closing the bottom of said heater cavity, the closure panel having an opening through which said lead wires extend, the heater plate including clips on the downturned sides of the ceramic panel and retaining said closure plate in predetermined position, the heater plate having a foamed epoxy filler in the heater cavity and sealed entirely around the periphery of the ceramic panel to the downturned sides thereof and to the closure plate to exclude such corrosive chemicals from the heater cavity, the filler also providing efficient heat insulation and being extruded around the edges of the closure panel adjacent the downturned sides of the ceramic panel and sealing around said lead wires at the opening in the panel, the foamed epoxy filler embedding and completely enclosing the ends of the encasing sleeve of the lead wire in the heater cavity, a high temperature resisting and insulating pad in and extending entirely across the heater cavity between the downturned panel sides and lying between the filler and the ceramic panel, and an electric resistance heating element in the heater cavity and disposed between the pad and the ceramic panel, the heating element being pressed against and in intimate engagement with the ceramic panel and retained against the panel by pressure exerted from the filler through the high temperature resisting pad to thereby efficiently transfer heat from the heating element to and through the ceramic panel to the heating load carried thereon; and means including a post formed integrally of and in one piece with said housing for connecting the heater plate to said base.

6. The hot plate according to claim 5 wherein said clips and said closure plate of the heater plate being coated with a fluorocarbon resin-type plastic to be substantially impervious to action of corrosive chemicals.

* * * * *